US008840970B2

(12) United States Patent
Yializis et al.

(10) Patent No.: US 8,840,970 B2
(45) Date of Patent: Sep. 23, 2014

(54) SELF-ASSEMBLED FUNCTIONAL LAYERS IN MULTILAYER STRUCTURES

(75) Inventors: Angelo Yializis, Tucson, AZ (US); Gordon Goodyear, Tucson, AZ (US)

(73) Assignee: Sigma Laboratories of Arizona, LLC, Tucson, AZ (US)

( * ) Notice: Subject to any disclaimer, the term of this patent is extended or adjusted under 35 U.S.C. 154(b) by 433 days.

(21) Appl. No.: 13/007,639

(22) Filed: Jan. 16, 2011

(65) Prior Publication Data

US 2012/0184165 A1 Jul. 19, 2012

(51) Int. Cl.

| | |
|---|---|
| ***B05D 1/40*** | (2006.01) |
| ***B05D 3/00*** | (2006.01) |
| ***C08J 7/18*** | (2006.01) |
| ***C08J 7/06*** | (2006.01) |
| ***H05H 1/00*** | (2006.01) |
| ***D04H 1/559*** | (2012.01) |

(52) U.S. Cl.
CPC ..... *D04H 1/559* (2013.01)
USPC ..... 427/532; 427/535; 427/536; 427/538; 427/539; 427/490; 427/497

(58) Field of Classification Search
CPC ..... C23C 14/5826; C23C 14/5837
USPC ..... 427/331, 490, 497, 532, 535, 536, 538, 427/539
See application file for complete search history.

(56) References Cited

U.S. PATENT DOCUMENTS

| | | | |
|---|---|---|---|
| 4,954,371 A | 9/1990 | Yializis | |
| 5,244,730 A | 9/1993 | Nguyen et al. | |
| 5,302,420 A | 4/1994 | Nguyen et al. | |
| 6,242,054 B1 | 6/2001 | Baalmann et al. | |
| 6,397,458 B1 | 6/2002 | Jones et al. | |
| 6,419,871 B1 | 7/2002 | Ogale | |
| 6,444,274 B2 | 9/2002 | Gorbig | |
| 6,468,595 B1 | 10/2002 | Mikhael et al. | |
| 6,562,112 B2 | 5/2003 | Jones et al. | |
| 6,562,690 B1 | 5/2003 | Cheung et al. | |
| 6,774,018 B2 | 8/2004 | Mikhael et al. | |
| 6,802,315 B2 * | 10/2004 | Gahan et al. | 128/206.12 |
| 6,953,544 B2 | 10/2005 | Jones et al. | |
| 7,115,310 B2 | 10/2006 | Jaccoud | |
| 7,157,117 B2 | 1/2007 | Mikhael et al. | |
| 7,244,292 B2 | 7/2007 | Kirk et al. | |
| 7,255,291 B1 | 8/2007 | Lo et al. | |

(Continued)

OTHER PUBLICATIONS

R.M. France, et al., "Plasma Treatment of Polymers", J. Chemical Soc. Faraday Trans., 1997, 93(17), pp. 3173-3178.

*Primary Examiner* — Jennifer Chriss
*Assistant Examiner* — Camie Thompson
(74) *Attorney, Agent, or Firm* — Yakov Sidorin; Quarles & Brady LLP; Antonio Durando

(57) ABSTRACT

Functionalized multilayer structures are manufactured by a process whereby a substrate material is treated with a reactive-gas plasma to form an activated layer on the surface thereof, and then by depositing a liquid functional monomer on the activated layer to form a self-assembled functional layer. Any excess liquid monomer must be allowed to re-evaporate in order to obtain optimal functionality on the surface of the resulting structure. The deposition of the liquid layer is preferably carried out with high kinetic energy to ensure complete penetration of the monomer throughout the body of the substrate. For particular applications, prior to formation of the reactive layer the substrate may be coated with a high glass-transition temperature polymer or a metallic layer.

20 Claims, 3 Drawing Sheets

(56) References Cited

U.S. PATENT DOCUMENTS

| | | | | |
|---|---|---|---|---|
| 7,300,859 | B2 | 11/2007 | Mikhael et al. | |
| 7,824,742 | B2 | 11/2010 | Von Gellhorn et al. | |
| 2007/0166528 | A1* | 7/2007 | Barnes et al. | 428/304.4 |
| 2009/0221113 | A1* | 9/2009 | Chang et al. | 438/99 |
| 2010/0098876 | A1* | 4/2010 | Hanson | 427/535 |
| 2011/0262699 | A1* | 10/2011 | Yializis et al. | 428/138 |

* cited by examiner

SELF-ASSEMBLED FUNCTIONAL LAYERS IN MULTILAYER STRUCTURES

BACKGROUND OF THE INVENTION

1. Field of the Invention

This invention is related in general to surfaces functionalized by vapor deposition and, in particular, to functionalization achieved by monomer deposition in the absence of monomer polymerization by radiation or other energy source.

2. Description of the Related Art

The term "functionalization" and related terminology are used in the art and herein to refer to the process of treating a material to alter its surface properties to meet specific requirements for a particular application. For example, the surface of a material may be treated to render it particularly hydrophobic and/or oleophobic and hydrophilic and/or oleophilic as may be desirable for a given use. Thus, surface functionalization has become common practice in the manufacture of many materials because it adds value to the end product. In order to achieve such different ultimate results, functionalization may be carried out in a variety of ways ranging from gaseous and wet chemistry to various vacuum deposition methods, sputtering, and plasma treatment.

Wet chemical processes have been used traditionally to treat with polymers and functionalize fibers that are otherwise inert or have limited surface functionality. These processes involve the immersion of the fibrous material in liquids or fluid foams designed to coat individual fibers and impart specific functionalities while retaining the material's porosity and ability to breathe. In spite of many claims it is clear that such wet-chemistry processes at best materially reduce the porosity of the substrate or, in the worst cases, essentially plug the interstices between fibers. Therefore, the functionalization of porous materials by wet-chemistry polymer deposition has produced the desired results in terms of surface functionality, but with the attendant deterioration of the mechanical characteristics of the underlying porous substrate.

Polymers applied by vacuum deposition have also been used successfully in the art to impart particular functional properties to films, foils and porous substrates without the limitations of wet coating processes. There is a large body of literature that addresses coatings using atmospheric and vacuum plasma processes (see for example U.S. Pat. Nos. 5,244,730, 5,302,420, 6,242,054, 6,397,458, 6,419,871, 6,444,274, 6,562,112, 6,562,690, 6,774,018, 7,244,292, 7,115,310, 7,255,291, 7,300,859 and 7,824,742). Vacuum plasma polymerization methods have been explored for at least 40 years. Plasma-based coating can be quite effective in coating and functionalizing porous surfaces, but that process has had little commercial success in applications such as web coating that require high speed treatment, mainly for two reasons. One is that the physical and chemical properties of these coatings are highly dependent on process parameters such as pressure, electrode geometry and type of applied voltage (DC, AC, HFAC, Microwave). Typically, a relatively long exposure to the plasma is required to assure that a high enough concentration of functional moiety is deposited on the surface. This leads to the second limitation, which is process time. Most methods cited in the literature require plasma exposure times in the order of seconds to minutes, which can be commercially acceptable for batch applications, but not for roll-to-roll applications that require functionalization of webs at speeds in the order of 100 to 1000 feet per minute, with coating times in the order of milliseconds, in order to create products that are both functionally and economically viable.

U.S. Pat. Nos. 4,954,371, 6,468,595, and 7,157,117 disclose high-speed vacuum deposition polymer coating processes that are free of these plasma polymerization limitations and have been used commercially to functionalize porous webs several meters wide at process speeds greater that 1000 ft/min. These processes utilize flash evaporation of a monomer material that condenses on a moving substrate, followed by radiation curing using electron beam or UV radiation. A variety of monomers, such as free-radical polymerizable acrylates, cationic polymerizable epoxies, vinyl monomers, and others, are used to functionalize a substrate surface with a wide range of functionalities that include hydrophobicity, oleophobicity, hydrophilicity, oleophilicity, antibacterial, color, anti-stain, metal chelating and antistatic properties. These processes are limited to the use of radiation polymerizable monomers that have high enough vapor pressure to be flash-evaporated but also low enough to allow condensation on the substrate. This limitation excludes many lower molecular-weight monomers that may be particularly desirable for specific applications.

The present invention was born out of a need to functionalize with monomer materials that are not easy to polymerize using radiation and/or that can be flash-evaporated but have poor condensation properties. Accordingly, the invention lies in a surface functionalization technology suitable for replacing the high speed in-vacuum radiation curing process in applications where it is necessary to use functional monomers that are difficult to condense and/or polymerize. Such monomers include, for example, perfluoro acrylates and methacrylates derived from various perfluoro alcohols that have been allowed for use by the U.S. Environmental Protection Agency in replacement of longer-chain fluorine-containing molecules that are easier to polymerize but have been categorized as hazardous materials. In addition, the invention relates to a process that is also suitable for implementation at high speeds, which is an absolute requirement for commercial viability.

This invention addresses the functionalization of web substrates processed at high speed in a roll-to-roll process; although it applies to all types of substrates, including 3-D objects, the main focus is on substrates that have a certain level of porosity. Textiles, non-woven products and paper substrates are fiber-based porous materials with inherent properties derived from the nature of the fibers. Synthetic and natural fibers (for example, polypropylene, nylon, polyethylene, polyester, cellulosic fibers, wool, silk, and other polymers and blends) can be shaped into different products with a great range of mechanical and physical properties for applications that include protective uniforms, biomedical fabrics and membranes, housing products, and filter media for gas and liquid filtration. The porosity of these materials usually serves a necessary function, such as gas and/or liquid permeation, particulate filtration, liquid absorption, etc. Therefore, any subsequent treatment designed to further modify the chemical properties of the fibers by appropriately functionalizing them must be carried out, to the extent possible, without affecting the porosity of the material.

BRIEF SUMMARY OF THE INVENTION

In seeking ways to functionalize surfaces with monomers that cannot be condensed and cross-linked using a radiation source in a high-speed process, a new vacuum-based high speed surface functionalization process was developed that is described as a surface modification by self-assembly of specific functional monomer materials over a substrate. Self-assembly is a term used in various disciplines to describe processes in which a disordered system of pre-existing components forms an organized structure or pattern as a consequence of specific, local interactions among the components themselves, without external direction. When the constitutive components are molecules, the process is also termed molecular self-assembly. Depending on the monomer chemistry, the process of the invention can be used to create functional surfaces with different chemical properties, including low surface energy used to repel liquids such as water and organics and high surface energy used to enhance wettability.

The invention lies in a method for manufacturing functionalized multilayer structures and in methods for manufacturing them by treating a substrate material with a reactive-gas plasma to form an activated layer on the surface thereof, and then depositing a liquid functional monomer on the activated layer to form a self-assembled functional layer. Any excess liquid monomer must be allowed to re-evaporate in order to obtain optimal functionality on the surface of the resulting structure.

If the functional structure is produced for woven, non-woven and porous substrates, the deposition of the liquid layer is carried out with high kinetic energy to ensure the penetration of the monomer throughout the body of the substrate so that the self-assembled layer is formed on all sides and on the interior of the substrate. For certain applications, such as charged filter media, where the non-woven or porous substrate has a low glass transition temperature, the substrate is preferably first coated with a high glass-temperature polymer and this is then plasma treated to form a reactive layer that is coated with a self-assembled functional layer according to the invention.

If the functional structure is produced for charge-dissipating or low-emissivity heat-reflecting applications, the substrate is first coated with a metallic layer and this is then plasma treated to form an activated layer that is coated with the self-assembled layer of the invention to impart the desired functionality.

Various other purposes and advantages of the invention will become clear from its description in the specification that follows and from the novel features particularly pointed out in the appended claims. Therefore, the invention consists of the features hereinafter illustrated in the drawings, fully described in the detailed description of the preferred embodiments and particularly pointed out in the claims.

DETAILED DESCRIPTION OF THE PREFERRED EMBODIMENTS OF THE INVENTION

Figure 1:
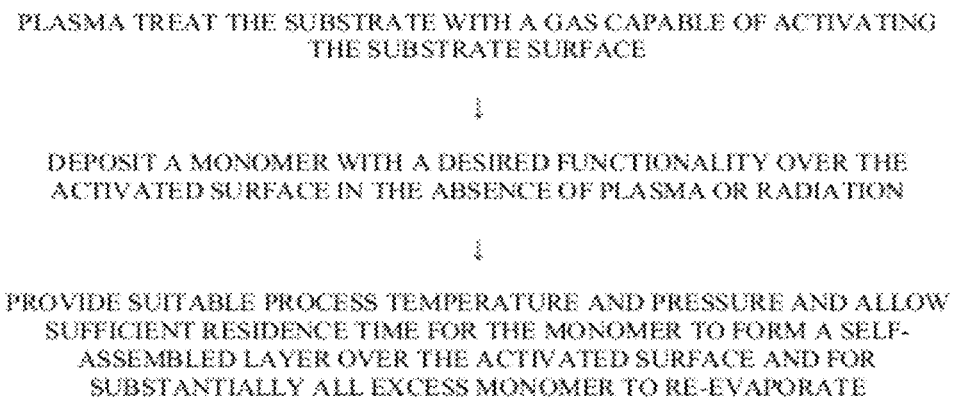
FIG. 1 is flow-chart of the steps involved in the process of the invention.

For the purpose of describing and claiming the present invention, the term "activated" is defined as containing free radicals, acidic or basic functional groups, or other reactive moieties. The term "reactive" and related words are defined as containing bonds or functional groups that react with activated surfaces. The term "non-woven," as it relates to a material, refers to a fabric-like material made from long fibers, bonded together by chemical, mechanical, heat or solvent treatment. The term is used to denote fabrics, such as felt, that are neither woven nor knitted.

We discovered that with specific functional monomers a substrate can be functionalized at high speeds and without the use of an energy source such as radiation curing or plasma-induced polymerization as long as the certain process conditions are concurrently satisfied, as follows:

a) The molecules containing functional moieties have to be capable of reacting with an activated surface, such as found in an acrylate, vinyl or other material that is known to react with surfaces activated by plasma treatment.

b) The density of reactive species in the monomer is high, ideally such that all monomer molecules react with the substrate surface. This is contrary to plasma-based polymerization where only a small fraction of the functional plasma gas (or vapor) is activated per unit time.

c) An activated layer is formed on the substrate prior to exposure to the monomer in order to produce a capture cross section for the monomer molecules as they come in contact with the surface of the activated layer. For the purposes of this disclosure, capture cross section is defined as the cross section that is effective for capturing monomer molecules by reaction with the activated substrate. The capture cross section is proportional to the reactivity of the activated surface layer, the reactivity of the monomer material, and the time a monomer molecule is in contact with the activated layer.

d) The monomer vapor pressure, the ambient pressure, the substrate temperature, and the monomer residence time on the substrate are such that the monomer has time to react with the activated layer, but also such that any excess monomer has time to re-evaporate so that only a self-assembled layer secured to the activated layer remains.

e) When functionalizing a porous surface, the monomer molecules are introduced into the process space with high kinetic energy in order to penetrate all sides of the substrate and coat the high surface area throughout the medium in as short a time as possible.

These conditions produce a unique self-assembly of the functional monomer layer at high speed and does not require polymerization by exposure to an external energy source. Unlike radiation or plasma-induced polymerization, where the functional monomer forms a cross-linked coating, the condensed monomer of the invention reacts with the activated layer on the substrate and assembles itself into a surface layer without any subsequent chain scission, ionization or free radical generation produced by an external energy source.

However, the requirements of the invention impose a series of limitations in the monomer chemistry that can be used, as well as in other process factors such as substrate temperature and ambient pressure, which control the time that the condensed monomer stays in contact with the substrate surface prior to re-evaporization. For any speed of the substrate through the process space and any particular monomer selected to impart a specific surface functionality, such temperature and pressure may be readily ascertained by one skilled in the art simply by controlling these parameters to ensure sufficient reaction time to form the self-assembled layer and to allow the re-evaporation of substantially all unreacted monomer. In contrast with prior-art processes, where the resulting functionalized surface contains a polymerized top layer of functional material, the present invention produces a self-assembled top layer of functional monomer molecules bonded to the underlying surface by reaction with pre-activated sites.

Figure 2:
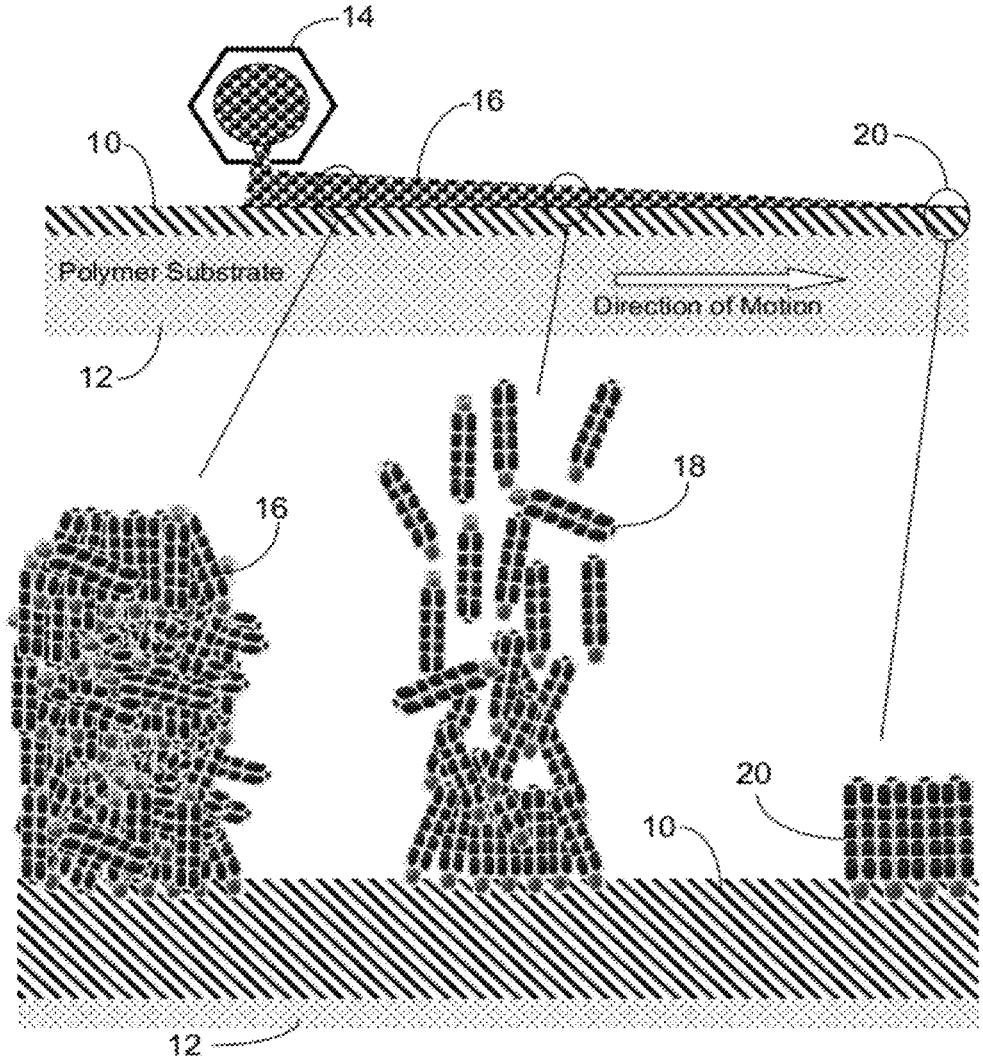
FIG. 2 is a sectional illustration of the self-assembled layer of the invention as it is being formed over a substrate.

The steps of the self-assembly process of the invention are described in the flow-chart of FIG. 1 and in the schematic illustration of FIG. 2. A nano-thick activated layer 10 is first created in conventional manner on a substrate 12 to produce a surface that is capable of reacting with the deposited functional monomer. This can be accomplished by various methods, including substrate modification using a high-power plasma to induce reaction of the substrate with plasma gases and gas mixtures that include Ar, $O_2$, $CO_2$, $N_2$, $C_2H_4$, and air. Although some differences in the formation of the activated layer can be detected using different plasma gases, experiments showed that all gases and gas mixtures could be made to work on a variety of surfaces, including metallic ones, given the proper level of plasma treatment. Most of the experimental work for the invention was conducted with an $Ar/O_2$ plasma-gas mixture that incorporates both the cleaning and etching properties of the large Ar atoms and the reactivity of the $O_2$ molecule in a single treatment step. Therefore, the invention is not limited to oxygen activation but it encompasses any plasma treatment that produces an activated surface over the underlying material.

Thus, the plasma pre-treatment process of the invention is performed to create an activated layer on the substrate surface. The thickness of the activated layer is based on the conditions of the plasma treatment and is well understood in the art, as detailed for different polymer substrates by the analysis published by R. M. France et al. in "*Plasma Treatment of Polymers,*" J. Chemical Soc. Faraday Trans., 1997, 93(17), pp. 3173-3178. This work shows that in most cases, even if argon alone is used to treat a surface, oxygen is always present on the activated surface and the depth (or thickness) of the modified layer is a function of substrate polymer chemistry and level of treatment.

Several experiments were conducted to determine the level of plasma necessary to produce an oxygen saturated activation layer. As shown by the examples below, less than full saturation leads to reduced performance of the self-assembly process. It should also be noted that for porous materials, such as fabrics and porous membranes, the plasma has to penetrate and modify all surfaces that are to be coated by the monomer vapor, including the back side of the substrate.

Once the activated layer 10 is formed, the substrate is moved to a different process zone away from the plasma field and the monomer is injected onto the activated layer from an adjacent heated linear nozzle 14. If the substrate consists of a porous material, a high kinetic energy of the monomer vapor is required in order to drive it though the porous material in the shortest time possible, which can be accomplished using a flash evaporation process (such as described in U.S. Pat. No. 4,954,371) where the monomer is first delivered into a heated, hermetically closed container (not shown in the figure) and it is evaporated as it contacts the container surface. The vapor then exits from the linear nozzle for deposition over the substrate. Such a nozzle and all related equipment are now conventional in the art. The difference in pressure between the vapor built up in the evaporator and the ambient pressure in the process space accelerates the monomer for deposition onto the substrate with a very high speed, which has been shown to reach even supersonic velocities, thereby assuring instant penetration and condensation of the monomer onto the porous substrate surface. Unlike evaporation from a liquid pool, the flow of injected monomer in the flash evaporator can be controlled to ensure that an exact quantity of monomer is deposited per unit time, which, when combined with the speed of the web, leads to a highly controllable process for depositing a condensed liquid monomer layer 16 of a specific thickness onto the substrate.

According to the invention, immediately after condensation the thin liquid monomer layer 16 starts to re-evaporate. The evaporation rate depends on several parameters that include the monomer's vapor pressure, the substrate temperature and the ambient pressure. Therefore, for a given monomer the substrate temperature and the ambient pressure of the process space must be judiciously selected to ensure both the initial condensation of the monomer to allow the self-assembled layer to form and the subsequent re-evaporation of the excess monomer material. As illustrated in the enlarged portions of FIG. 2, the layer 16 of condensed monomer is formed of randomly oriented molecules deposited over the activated layer 10 on the surface of the substrate 12. Because of the reactivity of the monomer molecules 18 and of the activated layer 10, the molecules at the bottom react with the active sites in the underlying surface and orient themselves to form the self-assembled layer 20 of the invention, leaving the remaining monomer molecules free to re-evaporate. In order for the self-assembled functional monomer to form to saturation over the activated layer 10, as necessary for a permanent functional layer to result, the liquid layer 16 needs to stay on the surface of the activated layer 10 long enough to fully react with it. Therefore, the thickness of the deposited monomer layer 16 is adjusted to assure that the monomer stays on the surface long enough to fully react before it is evaporated. However, it is also important that the excess monomer fully re-evaporate before the substrate is removed from the process chamber, a condition that can be controlled in conventional manner by manipulating the temperature of the substrate and the ambient pressure of the process space.

The formation of self-assembled functional layers according to the invention was demonstrated on polymer substrates such as polypropylene, polyethylene and polyester, on metal-coated surfaces (such as with copper and aluminum), and on polymer-coated substrates. Of particular interest was the functionalization of non-woven fabric surfaces with hydrophobic and oleophobic functionality. EPA regulations have created a need for more environmentally acceptable functional materials to produce various products, such as non-staining protective uniforms, functionalized membranes and filter media for gas and liquid filtration. Some protective materials for uniforms also require a charge-dissipating functionality. This may be accomplished using a charge-dissipating polymer coating or a metallized layer with a certain level of resistivity that functions to dissipate static charge. Accordingly many tests were run to prove the viability of the invention for satisfy these needs. The following examples illustrate the results obtained from such monomer deposition without any subsequent exposure to polymerizing radiation.

EXAMPLE 1

Figure 3:
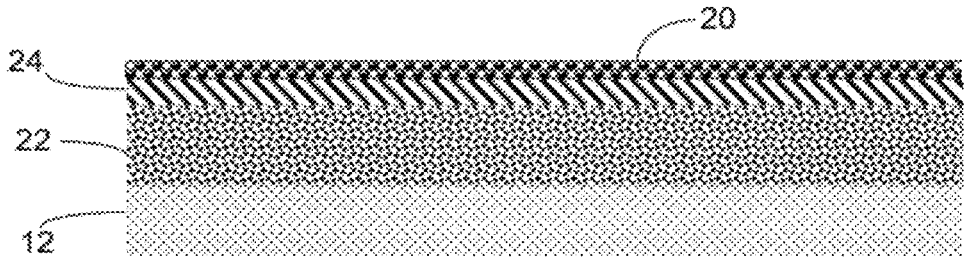
FIG. 3 is a sectional illustration of the self-assembled multilayer structure of the invention where a metallic layer has been deposited over the substrate prior to activation and self-assembly of the functional polymer.

A non-woven polypropylene fabric was processed roll to roll in a vacuum chamber. The non-woven web was approximately 35" wide. The objective was to create a phobic surface capable of repelling 100% Iso Propyl Alcohol (IPA) both on the non-woven fabric alone and on the same fabric rendered antistatic via metallization with a thin aluminum layer prior to the deposition of the phobic layer. Thus, one half of the web was metallized with an aluminum layer prior to functionalization according to the invention. The web was plasma treated to form an activated layer and a fluorine-containing monomer [2-(perfluorohexyl)ethyl methacrylate] was used for the self-assembly process. The web was first exposed to a 2.4 KW $Ar/O_2$ plasma to form an activated oxygen-containing layer (both on the metallized and non-metallized portions). The monomer was then fed to a flash evaporator at a fixed rate and the resulting vapor was injected onto the non-woven fabric while the fabric was moving at web speeds of 100 ft/min, 125 ft/min, 150 ft/min and 175 ft/min at an ambient vacuum pressure of 60 mtorr, which produced a high kinetic energy in the coating vapor. The coated substrate was rewound into a roll in the vacuum chamber. The different web speeds produced a variation in the plasma interaction with the substrate, a variation in the thickness of the condensed monomer layer, and a variation in the residence time, all of which lead to a variable quantity of monomer on the web and a variable time for the monomer layer to self assemble and for excess monomer to evaporate. FIG. 3 illustrates the metal layer 22, the activated layer 24, and the self-assembled monomer layer 20 as they result optimally as a multilayer structure in the metallized portion of the web. The samples so produced, both in the metallized and non-metallized portions of the web, were evaluated with standard tests for degree of repellency using various grades of water/isopropyl alcohol (IPA) mixtures, the ultimate objective being to attain 100% IPA repellency. The samples produced at 100 ft/min and 125 ft/min passed with 100% IPA repellency; the samples moving at 150 ft/min showed 90% repellency; and in those processed at 175 ft/min the degree of IPA repellency was 80%. The formation of the self-assembled layer on the metal surface demonstrates that the process can be used with any substrate as long as an activation layer can be formed on the surface to be functionalized.

The results of this experiment suggest that at the higher web speeds, either the activated layer was not fully formed (that is, the oxygen functional group had not fully saturated the surface) or there was not enough monomer condensed onto the surface for a long enough period to allow complete reaction with the activated layer prior to the monomer re-evaporation.

EXAMPLE 2

The conditions of Example 1 were repeated using an 80%/20% mixture of 1,1,2,2-tetrahydroperfluorodecyl acrylate and 1,1,2,2-tetrahydroperfluorododecyl acrylate, respectively, with the web moving at 175 ft/min. Under these conditions, the repellency was 100% IPA both on the metallized and unmetallized non-woven substrates. The difference in repellency performance between these monomers and the one in Example 1 is attributed to the fact that the monomers used in this example have higher molecular weight and higher reactivity (due to the acrylate bond), which delays re-evaporation and minimizes reaction time with the activated layer.

EXAMPLE 3

The conditions of Example 1 were repeated using 1.8 KW plasma with various plasma gases, including Ar, $Ar/O_2$ (80/20 mixture), $N_2$ and $CO_2$, at a web speed of 160 ft/min, and at 100 mtorr of ambient pressure. The fabric exhibited 100% resistance to wetting from IPA only with the $Ar/O_2$ plasma gas. With the other plasma gases, the degree of repellency fell below 80% IPA. This example showed that 100% IPA repellency was achieved at 160 ft/min with reduced plasma power, but at higher ambient pressure. The pressure at which various experiments had been conducted in earlier experiments was not specifically selected as a parameter, but instead the chamber had been pumped to the capacity of the vacuum pumps. This had led to dramatic inconsistencies in the wetting performance of the coated materials, which led to the recognition of the importance of ambient pressure and the related speed of re-evaporation of the deposited monomer on the formation of the self-assembled layer of the invention. It was thus established that a minimum interaction time between a monomer with a given reactivity and the oxygen-activated layer was necessary to obtain the desired surface functionality of the product. The following example demonstrates this effect.

EXAMPLE 4

The effect of ambient pressure on the re-evaporation rate of the deposited monomer was investigated using a 35" wide non-woven polypropylene (PP) web. An $O_2$ activated layer was formed using a 3.3 KW $Ar/O_2$ plasma, at web speeds of 125 ft/min, 180 ft/min, and 250 ft/min, and at ambient pressures of 25 mtorr, 100 mtorr, and 250 mtorr. A fluorine-containing monomer of (perfluorohexyl)ethyl methacrylate, injected into the evaporator at 50 ml/min, was used for the self-assembly process. Evaluation of the phobic performance of the self-assembled coatings revealed that at 25 mtorr the samples repelled less than about 70% IPA, at 100 mtorr all samples repelled 100% IPA, and at 300 mtorr the samples repelled up to 80% IPA.

These tests and additional experimentation thus showed that at low ambient pressures the monomer re-evaporates from the web at too high a rate to allow complete reaction with the activated layer. At a higher pressure, easily ascertained experimentally for a given monomer and specific operating conditions, the residence time of the monomer is optimal for it to react, form the self-assembled layer, and allow the excess liquid monomer to re-evaporate essentially in its entirety. At yet higher pressures, however, the monomer remains condensed on the fabric long enough for the fabric to be rewound into a roll where the interlayer pressure increases well above the ambient pressure (300 mtorr in the examples), thus allowing liquid monomer to exists in parts of the fabric surface after removal from the process chamber, which compromises the performance of the self-assembled layer. This discovery was confirmed by repeating the experiment of Example 4 at 300 mtorr, but, instead of removing the roll from the vacuum chamber, the material was re-wound at 300 mtorr back to the supply spindle and then back on the take up spindle before removing it from the vacuum. The extra exposure to the vacuum allowed complete re-evaporation of the liquid monomer and the performance of the non-woven medium was thereby elevated to 100% IPA repellency.

EXAMPLE 5

The effect of monomer reactivity was investigated by comparing the performance of 2-(perfluorohexyl)ethyl methacrylate monomer with that of 2-(perfluorohexyl)ethyl acrylate monomer, which would be expected to be more reactive based on the difference in reactivity between methacrylate and acrylate groups. An $Ar/O_2$ plasma produced at 2.4 KW was used to form the activated layer on a PP non-woven substrate and equal quantities of monomer were injected into the evaporator at web speeds varying from 125 ft/min to 300 ft/min were used at an ambient pressure of 120 mtorr. Evaluation of repellency performance of the coated media showed that the methacrylate monomer dropped below 100% IPA repellency at 250 ft/min (80% repellency), while the more reactive acrylate monomer was 100% at 250 ft/min and 80% IPA repellency at 300 ft/min. This test further confirmed the fact that the residence time required to obtain an optimal self-assembled layer of functional monomer depends on its reactivity and that sufficient time in required to allow the monomer to bond with the activated layer.

Air filter materials (filter media) are in most cases composed of non-woven materials that are electrically charged to attract and retain particulates. Such materials are also referred to as electrets, which basically are insulating materials with a trapped charge. Charging is usually performed by various methods that include corona discharge, conductive liquids, tribological techniques, and others. A superior filter medium is obtained from a surface that has both maximum water and oil repelling properties, as well as an embedded charge that does not easily dissipate. Charges in an insulator may be trapped deep in the polymer material and/or close to the surface. The surface charge can be easily reached by water and oil vapors that may cause them to be thermally stimulated out of the polymer with greater ease, while the charge trapped in deep traps is harder to remove. Ideally, charge should exist both in deep traps and in shallow traps, where it is closer to the surface and easier to remove but also closer to, and able to exerts a higher electrostatic force on, particulate matter. Most techniques used to produce electrets for filter applications are atmospheric processes that limit the charge to the polymer surface. In this invention, the vacuum environment provides the opportunity to incorporate charge also in deep traps in the polymer by using an electron beam curtain, as outlined in Example 6 below.

EXAMPLE 6

The conditions of Example 2 were repeated, except that the non-woven polymeric PP web was exposed to an electron beam with an accelerating voltage of 9.5 KV and 100 mA, 200 mA and 400 mA of current prior to the formation of the activated layer. Using an electrostatic voltmeter it was established that the level of charge was proportional to the electron current. Although dosimetry techniques are not available to measure the penetrating depth of 9.5 KV electrons, based on experience from curing polymer coatings of different thickness, the penetration depth of electrons under these conditions would be expected to extend from the surface to about 1.5 micrometers into the polymer surface, which makes it hard to remove.

Figure 4:
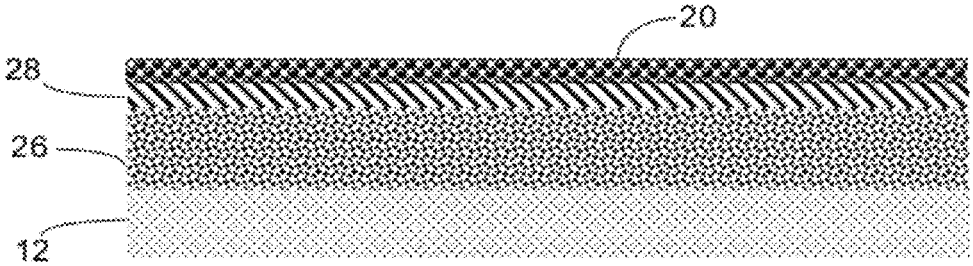
FIG. 4 is a sectional illustration of the self-assembled multilayer structure of the invention where a high glass-transition temperature layer has been deposited over the substrate prior to activation and self-assembly of the functional polymer.

The charge that is added to the surface of filter media must not dissipate significantly when exposed to higher temperatures, such as room temperature and above, and/or oil vapors that are present in many filter applications. Therefore, a most relevant test in the industry involves exposure of the filter medium to Di Octyl Phthalate (DOP) vapor at various temperatures to assure that the oil does not cause the filter to discharge prematurely. The function of the self-assembled polymer layer of the invention is to prevent wetting of the surface by oils, which will prolong the presence of charge. However, at room temperature and above, the polymer fibers of PP and PE, which have a Tg <0° C., undergo vibrational resonances and movement that can "open" the fiber surface and reduce the oil-repelling properties of the fluorinated coating. In order to minimize the adverse effect on filter charge caused by exposure to DOP vapor, it is much preferred to first coat the non-woven filter-medium substrate with a relatively high-Tg polymer layer, so as to preclude the adverse temperature effects on the substrate. Such polymer layer, which is significantly thicker that the self-assembled layer, can be deposited by various coating techniques, such as by conventional flash evaporation and radiation curing of the high-Tg monomer on the fiber surface. An activated layer is then formed on the high-Tg polymer to support the formation of the self-assembled layer. For optimum performance, the fibers are coated with a polymer material with a Tg greater than the maximum test temperature. Such polymer layer then provides a surface suitable for the formation of the oxygen-activated layer and subsequent self-assembly of the functional monomer layer. FIG. 4 illustrates the high-Tg polymer layer 26, the activated layer 28, and the self-assembled monomer layer 20 in the resulting multilayer structure.

EXAMPLE 7

A PP non-woven material, typical for media used in filter applications, was functionalized according to the invention on a roll-to-roll basis. The objective of this experiment was to improve the oleophobic and charge-retention performance of the filter medium when exposed to an environment that combines oil vapor and high temperature, as well as to embed charge deep into the polymer structure. Given that the typical PP non-woven medium has a glass transition temperature in the range of −10° C.<Tg<0° C., in order to improve its performance at temperatures as high as 40° C. to 60° C., where various oil exposure tests may be conducted, a high Tg coating was first applied onto the PP fabric by flash evaporating and electron-beam curing a dipropylene glycol diacrylate (with Tg of about 104° C.) at a thickness of 0.5 micrometers. The electron beam was set at 9.5 KV and 300 mA which cross-links the coating and penetrates about a micrometer or so into the polymer web. An activated layer and a self-assembled fluorinated coating were then formed on the high Tg acrylate coating using the conditions of Example 1, at 125 ft/min. The resultant functionalized fabric composed of PP/acrylate/$O_2$-activated-layer/self-assembled-fluoro-layer was highly durable, repelled 100% alcohol, it did not swell or absorb DOP, and could be effectively charged by corona.

We found that for optimal IPA-repellency performance as well as superior oleophobicity performance (which is also important for charge retention in filter media applications), the oxygen-based activated layer needs to be present throughout the filter medium (that is, on the front surface, throughout the fabric volume, and on the rear surface of the medium). Given that the flash-evaporated monomer is injected with high kinetic energy into the media (resulting in large part from the pressure differential during flash-evaporation), it always penetrates the fabric regardless of its initial repellency properties. If an oxygen-saturated activation layer does not exist throughout the medium, the self-assembled layer will not form the necessary molecular alignment, resulting in a reduced degree of repellency. After repeated experimentation we found that, if the repellency performance on the rear surface of the non-woven product is poor, oils such as DOP tend to swell the PP polymer during use, penetrate the medium from the rear surface, and eventually dissipate the original charge and compromise the effectiveness of the filter.

All fluoro-functionalized non-woven fabrics manufactured according to the invention were measured for IPA repellency both on the front and rear surfaces, and many of the samples were analyzed for atomic fluorine content using X-Ray Photoelectron Spectroscopy (XPS). The results of the XPS analysis, presented in Table 1, show that the atomic fluorine content on the surface of a non-woven medium is not a good indication of optimal repelling performance. In fact, there is no correlation between fluorine content and 100% IPA repellency. Although the prior art (see U.S. Pat. Nos. 6,419,871, 6,397,458, 6,953,544 and 7,244,292) teaches that 25% to 45% atomic-fluorine content is adequate for sufficient repellency performance to protect a filter electret from significant charge loss, the results of Table 1 show that according to this invention even 50% atomic fluorine may not be sufficient for maximum repellency. In fact, visual observations of the wetting angle of 100% IPA droplets on the samples of Table 1 (which was difficult to quantify in degrees due to surface micro-roughness) showed significant differences in the wetting angle for samples that had the same atomic fluorine content, suggesting that fluorine content alone is not an adequate parameter to assure maximum repellency (which is a key parameter for producing filter media with superior charge retention). The prior art relies on coating or fluorinating a surface using some form of electrical discharge, like corona or plasma, which produces cross-linking of fluorine-containing molecular fragments that slowly form a conformal coating on the fiber surface with a complex chemical structure of saturated and unsaturated fluorine compounds. By contrast, in this invention complete unfractured molecules with a relatively high molecular weight are assembled onto the activated layer. Given the low hydrogen bonding in such fluorine-containing molecules, the molecules can be stacked close to one another ach other with a high stacking density as long as an activated layer exists with a high density of active sites. The XPS data of Table 1 suggest that the self-assembled layer reaches a level of maximum atomic fluorine content (40%-50%) well before it reaches a maximum repellency or perhaps even maximum molecular stacking density. A measure of maximum stacking density is 100% IPA repellency on both the front and rear surfaces of non-woven or porous media, as well as an F/C ratio of about one or higher, as determined by XPS analysis, on both the front and the back surfaces of the medium.

TABLE 1

XPS results of various fluorine-functionalized PP non-woven fabrics.

| Front Side of Non-Woven | | | | | Back Side of Non-Woven | | | | |
|---|---|---|---|---|---|---|---|---|---|
| % IPA Repellency | F | O | C | F/C | % IPA Repellency | F | O | C | F/C |
| 100 | 46.5 | 11 | 41.9 | 1.11 | 100 | 46.5 | 5.5 | 47.9 | 0.97 |
| 70 | 51.3 | 8.3 | 40 | 1.28 | <70 | 25.5 | 3.3 | 71.2 | 0.36 |
| 100 | 52.4 | 8.1 | 38.9 | 1.35 | <80 | 31 | 3.3 | 61.6 | 0.50 |
| 100 | 50.5 | 8.5 | 39.9 | 1.27 | <80 | 28.2 | 3.4 | 68.4 | 0.41 |
| 100 | 49.6 | 9.7 | 39.2 | 1.27 | 100 | 53.5 | 5.5 | 41 | 1.30 |
| 100 | 44.8 | 15.9 | 30.3 | 1.48 | 100 | 50.5 | 4.9 | 44.6 | 1.13 |
| <70 | 44.4 | 11.3 | 42.6 | 1.04 | <70 | 12.8 | 1.9 | 85.3 | 0.15 |
| <70 | 42.6 | 12.2 | 42 | 1.01 | <70 | 3.8 | 1.9 | 94.3 | 0.04 |
| 100 | 50.2 | 9 | 38.5 | 1.30 | 100 | 52.1 | 5.2 | 42.7 | 1.22 |
| 80 | 48.2 | 9.9 | 40 | 1.21 | <70 | 41.6 | 4.2 | 54.2 | 0.77 |
| <70 | 47.7 | 10.4 | 39.7 | 1.20 | <70 | 39.2 | 4 | 56.8 | 0.69 |

The fluorinated monomers were deposited at ambient pressures less than 100 mtorr.

Thus, the 100% IPA repellency test is used to measure the effectiveness of surface functionalization for applications that include protective uniforms, non-staining and self-cleaning textiles, charge-dissipating protective fabrics, and media for air and liquid filtration. However, another group of applications relevant to the invention is in the field of heat management, involving low-emissivity polymer films and breathing membranes for construction applications (building envelopes and facer films), window coverings (such as blinds, drapes and solar screen), blankets, sleeping bags, tents and performance apparel. The objective in these applications is to metallize a porous or non-porous substrate to produce a low-emissivity surface with heat-reflecting properties and then use a self-assembled layer to protect the metal surface from water and/or alcohol corrosion without affecting significantly the emissivity of the metallized surface. A continuous surface of polymer film metallized with copper or aluminum has an emissivity lower that about 0.03. If such a surface is coated with a thin protective polymer layer, the emissivity can be increased significantly, which impacts the ability of the surface to reflect heat. The exact emissivity change will depend on the thickness and chemistry of the polymer coating because different chemical bonds have varying degrees of infrared absorption. The advantage of using the nano-thin self-assembled coatings of the invention in these applications is that, because of the molecular thickness of the self-assembled layer, they provide corrosion protection as well as anti-stain and self-cleaning properties with virtually no effect on the emissivity of the metal surface.

EXAMPLE 8

Several substrates metallized with aluminum, including non-woven and polymer films, were first measured for their emissivity and evaluated for corrosion resistance by exposure to a steam environment for different periods of time. Samples from the same metallized batch of materials were processed using the monomer and the conditions of Example 1 and a self-assembled coating was formed at 125ft/min. The coated samples were then measured for emissivity values and corrosion resistance. The results in Table 2 show that the self-assembled layer deposited on the aluminum surface provided protection to the metallized layer without a measurable impact on the emissivity of the metal surface.

TABLE 2

Emissivity and corrosion resistance of aluminum-metallized substrates protected using a self-assembled layer

| | Metallized Substrates | | Metallized Substrates with a protective self-assembled layer | |
|---|---|---|---|---|
| Material Type | Emissivity (+/−0.005) | Time to Corrode Metallized Layer | Emissivity (+/−0.005) | Time to Corrode Metallized Layer |
| Non Woven PP | 0.25 | <2 min | 0.25 | >20 min |
| Polyester Film | 0.03 | <2 min | 0.03 | >20 min |

The self-assembly process of the invention was also tested with monomers having hydrophilic properties. Applications such as for incontinence materials (diapers), cleaning wipes, biomedical fabrics, tubing, capillaries, battery separators, specialty filters, etc, often require a hydrophilic surface. The thermoplastic materials (polypropylene, polyethylene, polyester, etc.) commonly used for such applications have a hydrophobic character and therefore need to be treated or coated with hydrophilic materials. Thus, the self-assembly process of the invention was tested with these materials using monomers with carboxyl and hydroxyl functional groups that are know to be hydrophilic. As long as the monomer fitted the requirements of vapor pressure and molecular weight that allowed flash evaporation, condensation and re-evaporation from the substrate, the self-assembly process was effective to impart hydrophilic functionality.

EXAMPLE 9

A non-woven, hydrophobic polypropylene fabric was used to demonstrate a self-assembled hydrophilic coating. The objective was to create a hydrophilic surface that allows the PP fabric, which is naturally hydrophobic, to wet with water. A monomer with an acidic functionality (beta-carboxyethyl acrylate) was used for the self-assembly process. The non-woven web was approximately 35" wide. The substrate was first exposed to an 3.2 KW $Ar/O_2$ plasma to form the activated oxygen-containing layer. The monomer was then injected at the rate of 65 ml/min onto the activated non-woven layer at web speeds of 75 ft/min and an ambient pressure (vacuum) of 100 mtorr. Wetting evaluation of the resulting PP fabric showed that water wetted the fabric immediately upon contact with its surface.

This invention can utilize a broad range of organic monomers with various reactive moieties. As one skilled in the art will readily appreciate, the formation of a self-assembled layer involves the selection of appropriate organic monomers with certain level of reactivity that can be evaporated, condensed and re-evaporated form a substrate. A large variety of compounds can be used either as single monomers or in a formulation of one or more components. These include:

Monofunctional acrylate and methacrylate compounds. Such monomer molecules could be aliphatic, cyclo-aliphatic, aromatic, halogenated, metalated, etc.

Alcohols such as allyl, methallyl, crotyl, 1-chloroallyl, 2-chloroallyl, cinnamyl, vinyl, methylvinyl, 1-phenallyl and butenyl alcohols; and esters of such alcohols with (i) saturated acids such as acetic, propionic, butyric, valeric, caproic and stearic, (ii) unsaturated acids such as acrylic, alpha-substituted acrylic (including alkylacrylic, e.g., methacrylic, ethylacrylic, propylacrylic, and the like, and arylacrylic such as phenylacrylic), crotonic, oleic, linoleic and linolenic; (iii) polybasic acids such as oxalic, malonic, succinic, glutaric, adipic, pimelic, suberic, azelaic and sebacic; (iv) unsaturated polybasic acids such as maleic, fumaric, citraconic, mesaconic, itaconic, methylenemalonic, acetylenedicarboxylic and aconitic; and (v) aromatic acids, e.g., benzoic, phenylacetic, phthalic, terephthalic and benzoylphthalic acids.

Acids and esters with lower saturated alcohols, such as methyl, ethyl, propyl, isopropyl, butyl, isobutyl, sec-butyl, tert-butyl, 2-ethylhexyl and cyclohexyl alcohols, and with saturated lower polyhydric alcohols such as ethylene glycol, propylene glycol, tetramethylene glycol, neopentyl glycol and trimethylolpropane.

Lower polyhydric alcohols, e.g., butenediol, and esters thereof with saturated and unsaturated aliphatic and aromatic, monobasic and polybasic acids, examples of which appear above.

Esters of the above-described unsaturated acids, especially acrylic and methacrylic acids, monohydroxy and polyhydroxy materials such as decyl alcohol, isodecyl alcohol, oleyl alcohol, stearyl alcohol, epoxy resins and polybutadiene-derived polyols.

Vinyl cyclic compounds including styrene, o-, m-, p-chlorostyrenes, bromostyrenes, fluorostyrenes, methylstyrenes, ethylstyrenes and cyanostyrenes; di-, tri-, and tetrachlorostyrenes, vinylnapthalene, vinylcyclohexane, divinylbenzene, trivinylbenzene, allylbenzene, and heterocycles such as vinylfuran, vinylpridine, vinylbenzofuran, N-vinylcarbazole, N-vinylpyrrolidone and N-vinyloxazolidone.

Ethers such as methyl vinyl ether, ethyl vinyl ether, cyclohexyl vinyl ether, octyl vinyl ether, diallyl ether, ethyl methallyl ether and allyl ethyl ether.

Ketones, e.g., methyl vinyl ketone and ethyl vinyl ketone.

Amides, such as acrylamide, methacrylamide, N-methylacrylamide, N-phenylacrylamide, N-allylacrylamide, N-methylolacrylamide, N-allylcaprolatam, diacetone acrylamide, hydroxymetholated diacetone acrylamide and 2-acrylamido-2-methylpropanesulfonic acid.

Aliphatic hydrocarbons; for instance, ethylene, propylene, butenes, butadiene, isoprene, 2-chlorobutadiene and alpha-olefins in general.

Alkyl halides, e.g., vinyl fluoride, vinyl chloride, vinyl bromide, vinylidene chloride, vinylidene bromide, allyl chloride and allyl bromide.

Acid anhydrides, e.g., maleic, citraconic, itaconic, cis-4-cyclohexene-1,2-dicarboxylic and bicyclo(2.2.1)-5-heptene-2,3-dicarboxylic anhydrides.

Acid halides such as cinnamyl acrylyl, methacrylyl, crotonyl, oleyl and fumaryl chlorides or bromides.

Nitriles, e.g., acrylonitrile, methacrylonitrile and other substituted acrylonitriles.

Monomers with conjugated double bonds.

Thiol monomers

Monomers with allylic double bonds.

Monomers with epoxide groups and others.

Substrates suitable for the invention may be anyone from the various groups of non-woven materials, woven materials, natural fibers, synthetic fibers, polymer films, and metal foils used in the art.

While the invention has been shown and described herein in what is believed to be the most practical and preferred embodiments, it is recognized that departures can be made therefrom within the scope of the invention. For example, though the experimental work for the invention was conducted in a vacuum chamber, it is believed that the self-assembly process disclosed herein can be carried out at higher pressures as well, including atmospheric. At higher pressures, where the deposited monomer cannot re-evaporate, re-evaporation could be induced by heating the monomer-coated substrate. Similarly, while an $Ar/O_2$ plasma-gas mixture was used in the examples, it is also possible to form an activated layer with plasmas that contain mixtures of oxygen with other gases and/or vapors, as well as with plasmas that contain non-oxygen-based active species, such as S, Cl, F and Br. Therefore, the invention is not to be limited to the details disclosed herein but is to be accorded the full scope of the claims so as to embrace any and all equivalent processes and products.

We claim:

1. A method for manufacturing, in the vacuum, a functionalized multilayer structure comprising steps of:

forming an activated oxygen-rich layer on a substrate in the vacuum with the use of oxygen-containing plasma;

depositing a liquid monomer material on said activated layer while oxygen functional groups of said layer are activated; and forming a self-assembled monomolecular functional layer by re-evaporation of excess of said liquid monomer material for a sufficient amount of time so that only the self-assembled monomolecular layer is formed.

2. The method of claim 1, further including a step of depositing a metallic layer on the substrate prior to the step of forming an activated oxygen-rich layer, and wherein said forming an activated oxygen-rich layer includes forming a reactive surface on a metallic layer.

3. The method of claim 2, wherein said depositing a liquid monomer material includes depositing a mono-molecular layer and wherein said depositing includes formation of a spatially organized structure from molecules of said liquid monomer without external influence.

4. The method of claim 1, wherein the forming an activated oxygen-rich layer includes forming an activated oxygen-rich layer on a substrate that is selected from a group consisting of a non-woven polymer material, woven material, natural fibers, synthetic fibers, polymer films, metal foil, and a combination thereof, and wherein the depositing includes depositing the liquid monomer material containing a fluorine-containing monomer material.

5. The method of claim 4, wherein the depositing includes depositing the fluorine-containing monomer layer containing a static electron charge to form an electret functionalized multilayer structure.

6. The method of claim 5, further comprising injecting the non-woven polymer material with an electron charge before the step of forming the activated layer.

7. The method according to claim 1, wherein the depositing includes depositing a liquid monomer material containing a material defining water and oil-repelling properties of the functionalized multilayer structure.

8. The method of claim 1, wherein the forming a self-assembled monomolecular functional layer includes forming the self-assembled monomolecular functional layer with a surface energy sufficiently low to repel at least 80% alcohol brought into contact therewith.

9. The method of claim 1, wherein the forming a self-assembled monomolecular functional layer includes forming the self-assembled monomolecular functional layer including a material defining hydrophilic properties of the functionalized multilayer structure.

10. The method according to claim 1, wherein the forming a self- assembled monomolecular functional layer includes forming the self-assembled monomolecular functional layer including fluorine and carbon in an atomic ratio that is not less than one.

11. The method of claim 1, wherein the forming an activated oxygen-rich layer includes forming a fully-oxygenated activated layer.

12. The method of claim 1, wherein the forming a self-assembled monomolecular functional layer includes forming the self-assembled monomolecular functional layer having a thickness defined to substantially not affect emissivity of a surface of the substrate.

13. A method for making an electret filter medium comprising steps of:

coating a polymeric non-woven web with a polymer layer having a glass transition temperature greater than 40° C.;

forming an activated oxygen-rich reactive layer on a surface of said polymer layer in the vacuum with the use of oxygen-containing plasma, said activated reactive layer having a capture cross-section proportional to reactivity of said activated reactive layer;

depositing a liquid monomer material onto said activated reactive layer while oxygen functional groups of said activated reactive layer are activated;

forming a self-assembled monomolecular functional layer of the electret filter medium by re-evaporation of excess of said liquid monomer material for a sufficient amount of time so that only the self-assembled monomolecular layer is formed, and injecting an electric charge.

14. The method of claim 13, wherein said injecting includes injecting an electric charge into the polymer layer prior to the forming the activated oxygen-rich reactive layer.

15. The method of claim 13, wherein the depositing a liquid monomer material includes fluorinating the activated reactive layer by depositing a fluorine-containing monomer layer to produce a fluorinated multilayer structure.

16. The method of claim 13, wherein the forming a self-assembled monomolecular functional layer includes forming the self-assembled monomolecular functional layer with a surface energy sufficiently low to repel at least 80% alcohol brought into contact therewith.

17. The method of claim 13, wherein the forming a self-assembled monomolecular functional layer includes forming the self-assembled monomolecular functional layer including a material defining hydrophilic properties of the electret filter medium.

18. The method according to claim 13, wherein the forming a self-assembled monomolecular functional layer includes forming the self-assembled monomolecular functional layer including fluorine and carbon in an atomic ratio that is not less than one.

19. The method of claim 13, wherein the forming a self-assembled monomolecular functional layer includes forming the self-assembled monomolecular functional layer including a material defining water and oil repelling properties of the electrets filter medium.

20. The method of claim 13, wherein the forming an activated oxygen-rich reactive layer includes forming a fully-oxygenated activated layer.

* * * * *